US005974842A

United States Patent [19]

Schlack et al.

[11] Patent Number: 5,974,842

[45] Date of Patent: Nov. 2, 1999

[54] LOCKING SLIDE LATCH

[75] Inventors: Richard E. Schlack, Rising Sun, Md.; Edward A. McCormack, Media, Pa.

[73] Assignee: Southco, Inc., Concordville, Pa.

[21] Appl. No.: 08/933,779

[22] Filed: Sep. 19, 1997

Related U.S. Application Data

[63] Continuation-in-part of application No. 08/780,214, Jan. 8, 1997.

[51] Int. Cl.[6] ..... E05B 13/10

[52] U.S. Cl. ..... 70/208; 292/175; 292/DIG. 63; 292/DIG. 31; 292/153; 70/DIG. 80; 70/488; 70/144

[58] Field of Search ..... 292/153, 170, 292/169, 169.14, 169.18, 169.19, DIG. 38, 175; 70/208, 210, DIG. 67, DIG. 80, 144, 488

[56] References Cited

U.S. PATENT DOCUMENTS

| | | | |
|---|---|---|---|
| 137,211 | 3/1873 | Jones . | |
| D. 208,088 | 7/1967 | Banner . | |
| D. 230,132 | 1/1974 | Pastva, Jr. . | |
| D. 324,636 | 3/1992 | Schlack et al. . | |
| 550,424 | 11/1895 | Smith | 292/169.21 |
| 824,780 | 7/1906 | Ecker . | |
| 1,675,591 | 7/1928 | Bell | 292/175 |
| 2,922,297 | 1/1960 | Hitzelberger | 70/144 |
| 3,389,932 | 6/1968 | Pastva, Jr. . | |
| 3,469,875 | 9/1969 | Ahlgren | 292/DIG. 38 |
| 3,841,674 | 10/1974 | Bisbing et al. . | |
| 3,850,464 | 11/1974 | Bisbing et al. . | |
| 4,470,624 | 9/1984 | Bisbing | 292/DIG. 38 |
| 4,475,311 | 10/1984 | Gibson | 292/153 |
| 4,635,397 | 1/1987 | Wooten | 292/153 |
| 4,641,506 | 2/1987 | Boucher | 292/153 |
| 4,790,579 | 12/1988 | Maxwell et al. . | |
| 5,096,240 | 3/1992 | Schultz | 292/153 |
| 5,121,951 | 6/1992 | Harbum et al. . | |
| 5,193,707 | 3/1993 | Mizumura | 292/175 |
| 5,482,333 | 1/1996 | Gehrs et al. | 292/DIG. 63 |

FOREIGN PATENT DOCUMENTS

| | | | |
|---|---|---|---|
| 2386670 | 12/1978 | France . | |
| 1184431 | 6/1968 | United Kingdom . | |
| 2231612 | 11/1990 | United Kingdom | 292/DIG. 38 |

OTHER PUBLICATIONS

DZUS Catalogue, p. 35, Series 404 Latch.

Camloc Catalogue, p. F–95, PTL30 Series Latch.

Eberhard Catalogue No. 103 (1985) Section 1, p. 87, Slam Latch No. 4821.

Southco Latches and Access Hardware Handbook 43 (1993) pp. G–3, G–6, G–7, G–18 and G–19.

*Primary Examiner*—Darnell M. Boucher
*Attorney, Agent, or Firm*—Paul & Paul

[57] ABSTRACT

A locking slide latch comprises components that are easily assembled without the need for separate fasteners or adhesives. A presently preferred latch comprises a housing, a pawl received within the housing and an actuating member associated with and slidable relative to the housing for displacing the pawl from an extended position to a retracted position. These components are assembled together without the use of separate fasteners or adhesives, thereby simplifying assembly and allowing for interchangeability of parts to meet varying latch requirements. The latches are preferably manufactured from corrosion resistant materials such as plastics, composites and corrosion resistant metals, and are highly suitable for use in automotive, recreational vehicle and marine applications.

18 Claims, 12 Drawing Sheets

LOCKING SLIDE LATCH

CROSS-REFERENCE TO RELATED APPLICATIONS

This is a continuation-in-part of U.S. patent application Ser. No. 08/780,214 filed Jan. 8, 1997 currently allowed.

BACKGROUND OF THE INVENTION

1. Field of the Invention

The present invention relates to slide latches for doors, panels and the like. The latches incorporate a locking feature and are resistant to corrosion, making them useful in automotive, recreational vehicle, marine and other applications.

2. Brief Description of the Prior Art

Various types of slide latches are known. These latches are inserted in a cut-out opening of one panel and are slidable in the plane of the panel to engage a second panel or frame member. Conventional slide latches are typically non-locking and can be relatively complex to assemble and susceptible to corrosion.

U.S. Pat. Nos. 3,841,674 and 3,850,464 to Bisbing, et al., which are hereby incorporated by reference, disclose slide latches of one-piece or two-piece construction that do not include a locking feature.

The present invention has been developed in view of the foregoing, and to overcome the deficiencies of the prior art.

SUMMARY OF THE INVENTION

An object of the present invention is to provide a novel locking slide latch.

Another object of the present invention is to provide a slide latch comprising a housing, a pawl received within at least a portion of the housing and actuator means associated with and slidable relative to the housing for displacing the pawl from an extended position to a retracted position.

A further object of the present invention is to provide a slide latch comprising a housing, a pawl mounted on the housing for movement between an extending position and a retracted position relative to the housing, biasing means between the pawl and the housing for urging the pawl to its extended position, actuator means mounted on and slidable relative to the housing and coupled to the pawl for moving the pawl to its retracted position and a lock plug mounted on the actuator means and having a locking member.

Another object of the present invention is to provide a locking slide latch that comprises components that can be assembled together without the use of conventional fasteners such as screws and adhesives.

A further object of the present invention is to provide a locking slide latch that is resistant to corrosion.

These and other objects of the present invention will become more readily apparent from the following description.

DETAILED DESCRIPTION OF THE PREFERRED EMBODIMENTS

Figure 1:
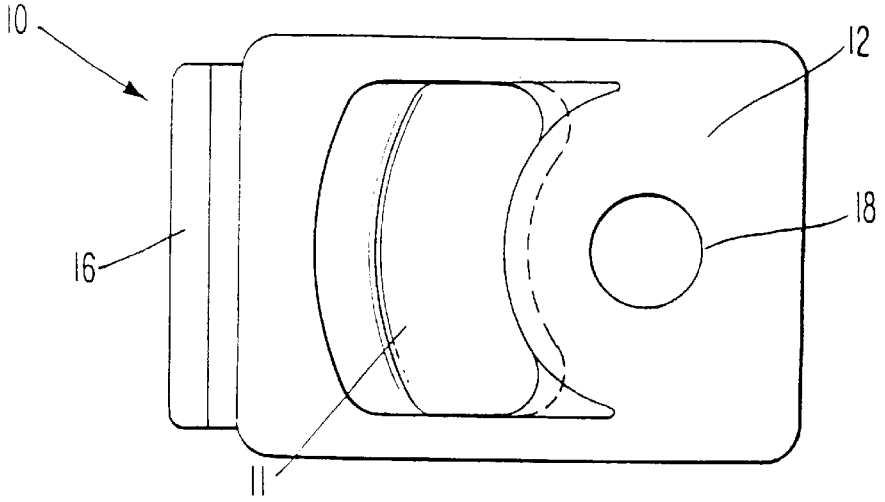
FIG. 1 is a top view of the body portion of a latch of the present invention.
Figure 2:
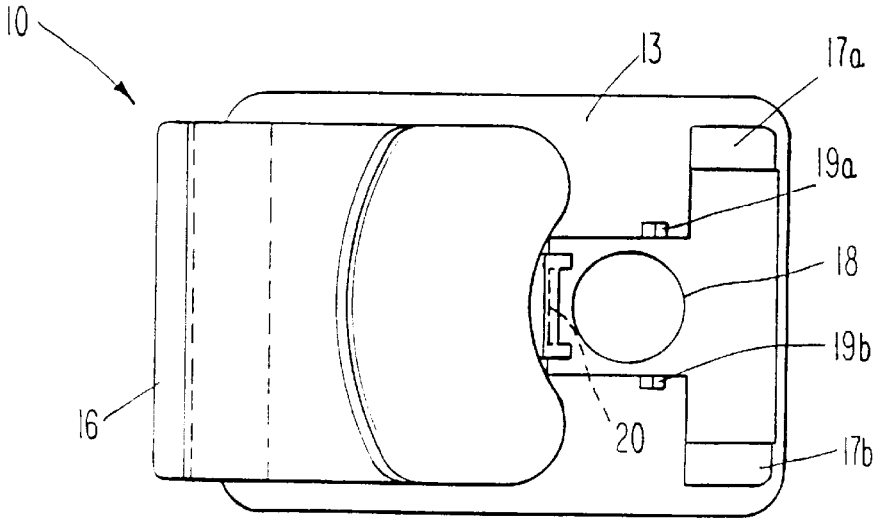
FIG. 2 is a bottom view of the body portion of a latch of the present invention.
Figure 3:
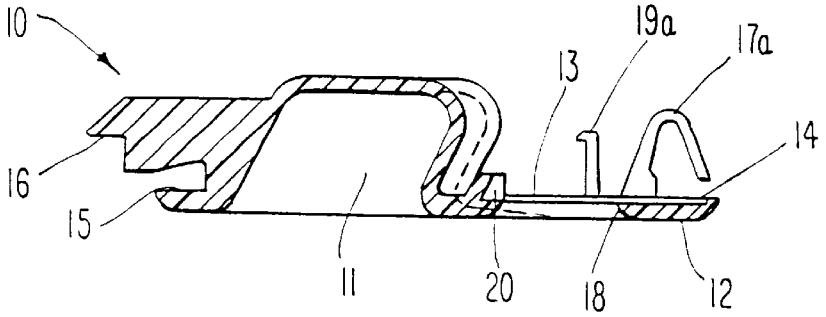
FIG. 3 is a sectional side view of the body portion of a latch of the present invention.

The locking slide latch of the present invention comprises a body portion that serves as a handle, a spring member that serves to bias the body portion in a closed position when the latch is installed, and a locking member that is rotatable into a position that prevents opening of the latch. Referring to the drawings in detail, in which like reference numbers represent like elements throughout the several drawings, FIGS. 1–3 show the gripable base member 10 of a preferred latch of the present invention. The base member 10 includes a handle opening 11 that is adapted to be gripped by an operator for opening the latch. The base member 10 includes a from surface 12 and a back surface 13 that is adapted to slide against the panel in which the base member is installed. The base member 10 includes an engaging portion 16 adapted to engage a second panel or frame member (not shown) when the latch is in the closed position. The term "frame member" as used herein is defined broadly to include any structure, such as a frame or panel, that is capable of being fastened to the panel in which the slide latch of the present invention is installed. As shown most clearly in FIG. 3, the base member includes end portions 14 and 15 that contact the panel in which the latch is installed (not shown). A pair of compliant clips 17*a* and 17*b* are located at one end of the base member and are adapted to secure the base member within the cut-out portion of the panel after the base member is snapped into place in the panel. The base member 10 includes a through-hole 18 extending from the front surface 12 to the back surface 13 that is adapted to receive a rotating lock plug, as more fully described below. On the back 13 of the base member, surrounding the through-hole 18, are prongs 19*a* and 19*b* and angled recess 20 that serve to secure the spring member when the latch is assembled, as discussed below.

The base member 10 may be manufactured from any suitable material such as plastic or metal. ABS plastic is a particularly preferred material for the base member due to its durability, ease of fabrication, low cost and resistance to corrosion. Although the base member 10 is shown as a solid piece of material in the section view of FIG. 3, it is preferred to provide hollow portions in the base member in order to save weight and material costs.

Figure 4:
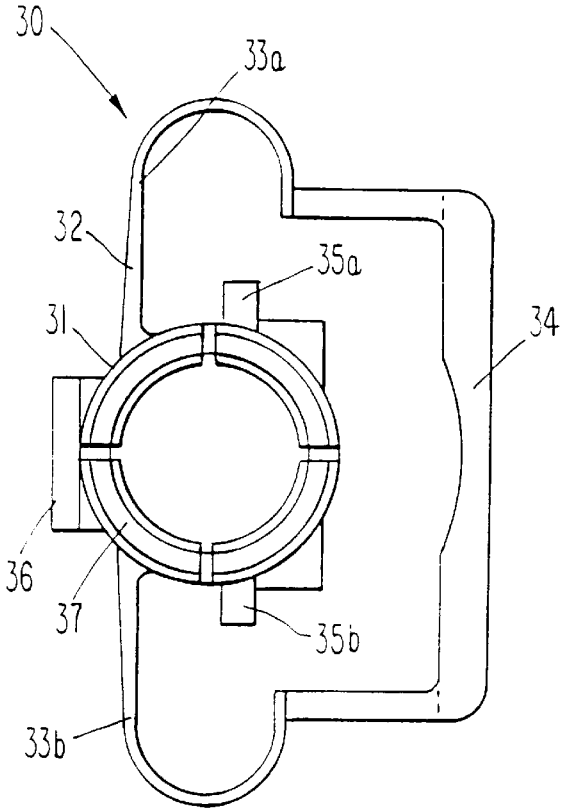
FIG. 4 is a top view of a spring member of the present invention.
Figure 5:
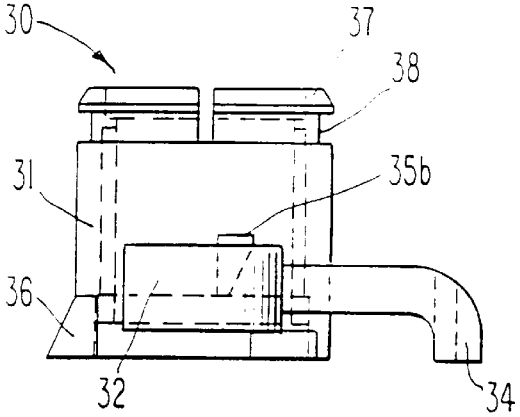
FIG. 5 is a side view of a spring member of the present invention.

FIGS. 4 and 5 illustrate a preferred spring member 30 of the present invention. The spring member 30 comprises a generally cylindrical body portion 31 with a complaint spring portion 32 extending therefrom. In the embodiment shown in FIGS. 4 and 5, the compliant spring portion 32 includes flexible sections 33*a* and 33*b* that provide flexure for the spring 32 and serve to bias the base member of the latch in the closed position when the latch is installed. A relatively rigid portion 34 extends from the flexible sections 33*a* and 33*b* of the spring and is adapted to contact the cut-out portion of the panel in which the latch is installed, the spring 32 is shown in the relaxed position in FIGS. 4 and 5. When force is applied from right to left on rigid member 34, flexure occurs in the flexible sections 33*a* and 33*b*, allowing rigid member 34 to move toward the cylindrical body 31 of the spring member. Shoulder 35*a* and 35*b* and angled retention member 36 are located around the periphery of the cylindrical body 31. When assembled, the shoulder members 35*a* and 35*b* engage the prongs 19*a* an 19*b* of the base member 10, and the angled retention member 36 engages the angled recess 20 of the base member 10. This engagement allows the spring member 30 to be snap-fit onto the base member 10 without the use of tools or conventional fastening means such as screws or adhesives.

In the preferred embodiment, the top of the cylindrical body portion 31 is divided into four quadrants 37 located at 90° intervals around the circumference of the cylinder. These divisions allow the quadrants to flex radially inward, thereby allowing a locking member to be snap-fit over the top of the cylinder 37. As shown most clearly in FIG. 5, a groove 38 of smaller radius is located below the top of the cylinder 37. When assembled, the locking member of the lath is retained within the groove 38 and rotates therein.

The spring member 30 can be manufactured from any suitable material such as plastic or metal. It is preferred to use corrosion resistant materials in the manufacture of the spring member. Acetels are preferred plastic for the spring member, with delrin being particularly preferred due to their excellent elasticity and resistance to corrosion, fracture and fatigue. It is also preferred to use a plastic that exhibits only minor changes in mechanical properties over varying temperature ranges. For example, if a latch of the present invention is to be subjected to a range of temperatures, it is desirable to use a plastic for the spring member that possesses relatively constant elasticity over the temperature range. As shown in FIGS. 4 and 5, the spring member 30 is preferably made from a single piece of material. However, various modifications can be made to the spring member, including the use of separate springs that are fastened to the cylindrical member 31. Such separate springs may be made of any suitable material such as plastic or stainless steel.

Figure 6:
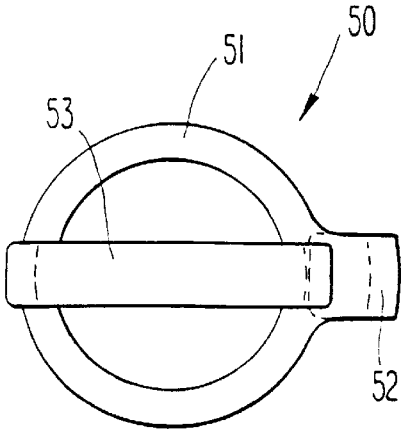
FIG. 6 is a top view of a locking member of the present invention.
Figure 7:
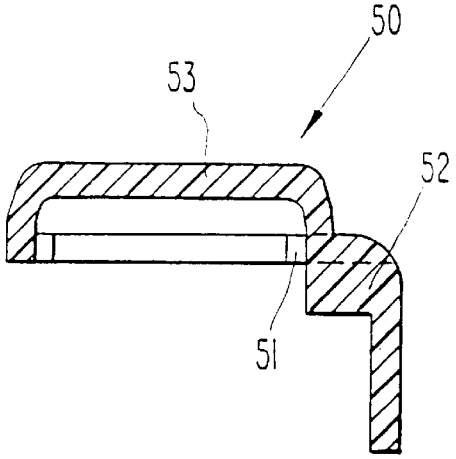
FIG. 7 is a side sectional view of a locking member of the present invention.

FIGS. 6 and 7 illustrate a preferred locking member 50 of the present invention. The locking member 50 includes a ring 51 that is adapted to be press-fit over the top 37 of the spring member 30 an to rotate in the groove 38. Extending radially outward and down from the ring member 51 is a locking finger 52 that is adapted to extend between the rigid member 34 and cylindrical base 31 of the spring member 30 when the locking member 50 is mounted on the a spring member 30. When assembled, the locking finger 52 may be rotated into a position against the rigid portion 34 of the spring member 30, thereby preventing movement of the rigid portion 34 toward the cylindrical body portion 31. The locking member 50 also includes a bar member 53 that extends across the diameter of the ring 51. The bar member 53 is adapted to contact a rotating lock plug or other actuating mechanism, as more fully described below.

The locking member 50 may be manufactured from any suitable material that possesses sufficient strength, such as metal, plastic or composite material. A particularly preferred material for the locking member 50 is glass filled nylon due to its excellent strength and corrosion resistance. Although the presently preferred configuration of the locking member 50 is shown in FIGS. 6 and 7, it should be recognized that the locking member may be provided in many different forms that allow locking of the latch when the locking member is rotated from an open to a closed position.

The preferred slide latch of the present invention also includes a lock plug that extends through the through-hole 18 of the base member 10 and contacts the locking member 50 in order to produce rotation thereof. This feature is shown most clearly in FIGS. 8F and 9. The lock plug 60 may be operated by a key. When the security of the key lock is not required, the lock plug 60 may be provided in the form of a generally cylindrical member that is freely rotatable by hand or by a tool actuator such as a hex wrench or screwdriver. The lock plug 60 includes protrusions 61*a* and 61*b* that are adapted to contact either side of the bar 53 of the locking member 50 when the latch is assembled. Rotation of the lock plug 60 causes rotation of the locking member 50 through contact between the protrusions 61*a* and 61*b* and the bar member 53. In the preferred key-operated lock plug, as shone in FIG. 3F, tumblers 62 are provided along one side of the plug. In addition, an E-ring 63 is provided on the lock plug 60 that is retractable in the radial direction in order to allow insertion of the lock plug 60 into the hollow cylindrical body portion 31 of the spring member 30. Once seated within the cylindrical body 31, the E-ring springs radially outward to secure the lock plug within the cylinder.

The components of the lock plug 60 are preferably manufactured from materials such as plastic and noncorrosive metal. In the presently preferred embodiment, the body of the lock plug 60 is manufactured from plastic, while the tumblers 62 and E-ring 63 are manufactured from brass. Such a lock plug is highly resistant to corrosion.

Figure 8A:
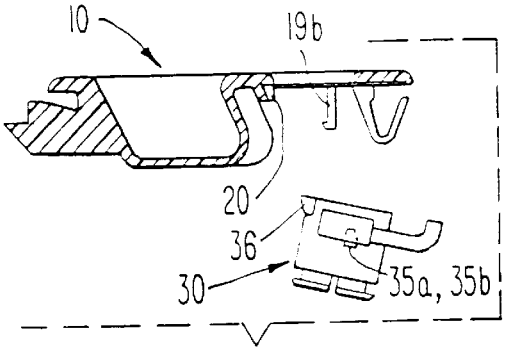
FIGS. 8A–F represent an assembly diagram of a latch of the present invention.
Figure 8B:
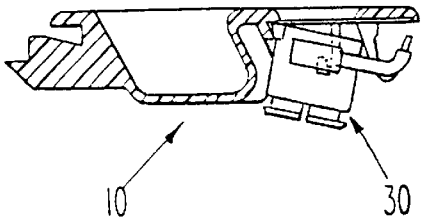
Figure 8C:
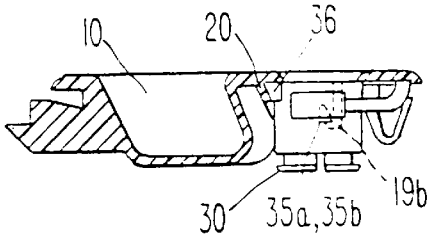
Figure 8D:
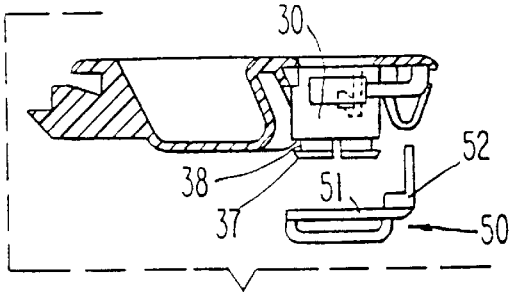
Figure 8E:
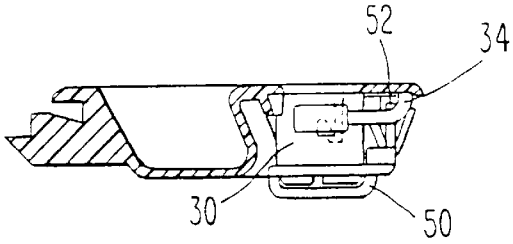
Figure 8F:
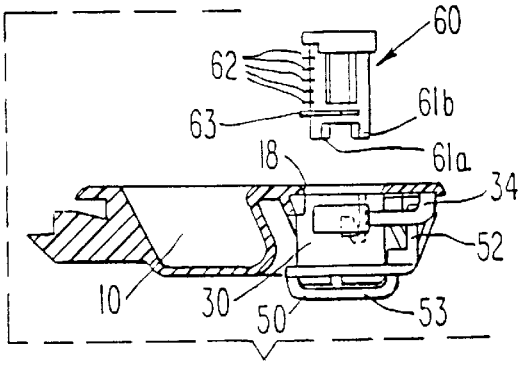

The method of assembling the preferred slide latch of the present invention is shown in FIGS. 8A–G. In FIG. 8A, the spring member 30 is oriented in relation to the base member 10 as shown. The angled recess 20 and prongs 19*a* and 19*b* are adapted to receive the angled retention member 36 and shoulders 35*a* and 35*b*, respectively. As shown in FIG. 8B, the angled retention member 36 is first inserted in the angled recess 20. In FIG. 8C, the prongs 19*a* and 19*b*, are snapped over the shoulders 35*a* and 35*b* in order to mount the spring member 30 to the base member 10. Such a snap-fit feature allows for ease of assembly without the need for tools or fasteners such as screws or adhesives. As an alternative, the spring member 30 may be fastened to the base member 10 by means of ultrasonic welding. In FIG. 8D, the locking member 50 is oriented as shown for subsequent mounting on the spring member 30. The ring 51 of the locking member 50 is snap-fit over the end 37 of the spring member 30 and is seated within the recessed groove 38. As shown in FIG. 8E, when the locking member 50 is mounted, the locking finger 52 may be disposed against the rigid member 34, thereby preventing movement of the rigid member 34 toward the cylindrical base 31 of the spring member 30. If the locking finger 52 is rotated away from contact with the rigid member 34, the rigid member is allowed to move toward the cylindrical base 31 of the spring member 30 against the force of the compliant portion 32 of the spring. In FIG. 8F, the lock plug 60 is oriented as shown with respect to the base member 10 and is then inserted through throughhole 18 and into the interior of the cylindrical body 31 of the spring member 30.

Figure 9:
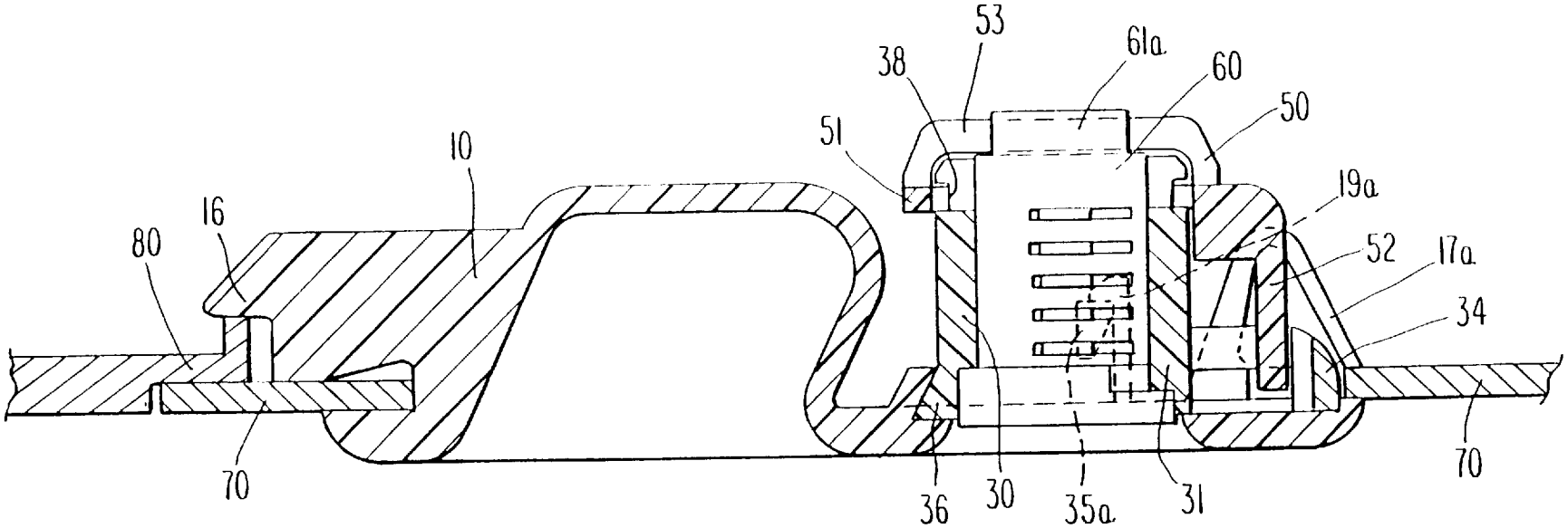
FIG. 9 sectional side view of an assembled latch of the present invention.

Once fully inserted, as shown in FIG. 9, the protrusions 61*a* and 61*b* of the lock plug 60 contact the sides of the bar member 53 of the locking member 50. Due to the contact between the protrusions 61*a* and 61*b* and the bar member 53, rotation of the lock plug causes rotation of the locking member 50. When the locking member 50 is in the orientation shown in FIG. 9 in which the locking finger 52 is against the rigid member 34, the latch is in the locked position. When the locking finger 52 is rotated a sufficient amount in either direction, e.g. 90°, there is no contact between the locking finger 52 and rigid member 34, thereby allowing the rigid member 34 to move toward the cylindrical base 31 of the spring member 30 when a sufficient force is applied thereto.

Once assembled in the manner shown in FIGS. 8A–F, the locking slide latch of the present invention may be installed in a cut-out portion of a panel in a manner similar to conventional, non-locking slide latches. The installation of such conventional latches is described in U.S. Pat. Nos. 3,841,674 and 3,850,464, cited previously. A fully assembled and installed slide latch is shown in FIG. 9. The base member 10 is located in a cut-out portion of a panel 70. In the latched position shown in FIG. 9, the engaging portion 16 of the base member 10 engages a frame member 80 to thereby releasably retain the panel 70 relative to the frame member 80.

As can be seen from the assembly drawings of FIGS. 8A–F, the slide latch of the present invention may be assembled simply without the use of tools. In addition, fastening means such as screws, rivets and adhesives used in conventional slide latches are not required during the assembly process. The use of the separate components for the base member 10, spring member 30, locking member 50 and lock plug 60 allows for many variations in the final latch, depending on the components selected. For example, the base member 10 may be provided in various dimensions to accommodate varying panel thicknesses. In this manner, the present latch may be altered to fit panels with thicknesses of less than 1 to greater than 10 mm. It is particularly preferred to provide the present slide latches in sizes that fit panels with thickness of from about 1.6 to about 6.5 mm. In addition, the end portion 16 of the member 10 may be altered to accommodate varying frame member sizes. Furthermore, the components of the present slide latches may be adjusted to provide variable grip ranges. Therefore, the slide latches of the present invention are adaptable to many varying applications and can be assembled to meet varying design criteria. Another advantage of the present slide latches is that they can be assembled without separate fasteners or adhesives and can easily be installed in a panel.

The locking mechanism provided on the slide latches of the present invention provides several advantages over conventional slide latches. Typically, slide latches are not provided with a locking feature. When it is desired to lock a conventional slide latch, a separate locking mechanism is usually provided on the panel adjacent to the latch. The slide latches of the present invention incorporate a locking mechanism directly therein, thereby providing simplified installation.

A major advantage of the preferred slide latches of the present invention is their resistance to corrosion. The latches are preferably manufactured from corrosion resistant materials such as plastics, thereby allowing for use in automotive, recreational vehicle and marine applications, where exposure to moisture and other corrosive elements is frequently encountered.

In FIGS. 10 to 14 is shown a locking slide latch in accordance with another preferred embodiment of the present invention. For the sake of clarity, the portions of the locking slide latch in accordance with the present embodiment which correspond to the portions described in relation to the locking slide latch earlier described and shown in FIGS. 1–9 will be described using the same number designations. The locking slide latch 100 similar to the locking slide latch earlier described also comprises, as portions thereof, a body portion, a spring member and a locking member. As will be described in more detail hereinafter, the primary differences in the locking slide latch 100 from that earlier described are the engaging portion 116, spring 130 and locking member 150.

Figure 13:
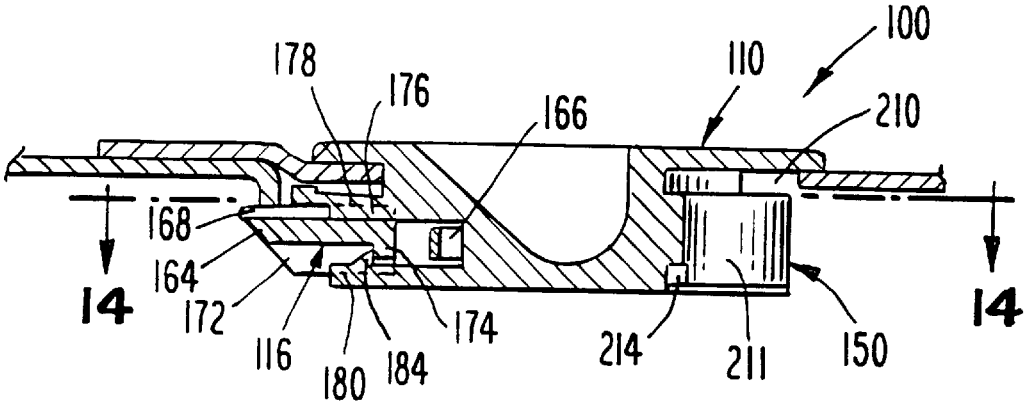
FIG. 13 is a right side elevational view of the latch of FIG. 10, taken along a line 12—12 of FIG. 11.
Figure 14:
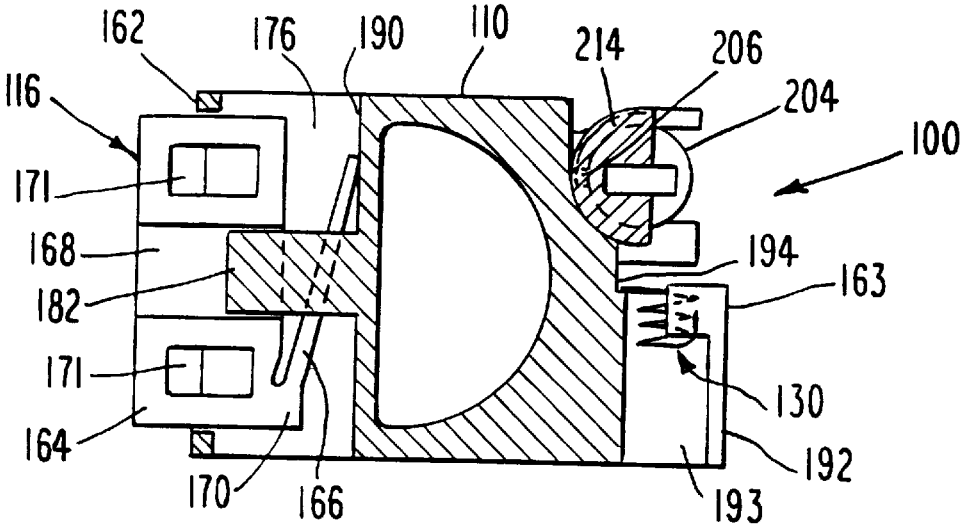
FIG. 14 is a top plan view of the latch of FIG. 10 taken along the line 14—14 of FIG. 13.

The base member 110 in this embodiment as shown in FIG. 14 includes a separate, independently operating engaging portion or pawl 116. The base member 110 includes a cavity 176 provided within a forward surface 162 into which the engaging portion 116 is received. The engaging portion 116 in this embodiment comprises a body 164 generally rectangular in configuration and biasing means attached with the body 164, which in this embodiment comprises a leg 166. The leg 166 in accordance with the present embodiment is generally elongated and attached at one end to the body 164, and with its terminating end being at spaced separation from the body 164. The leg 166 is sufficiently flexible in operation as will be described in further detail below. The body 164 of the engaging portion 116 includes a slot 168, generally rectangular in this embodiment, provided within its upper surface. In addition, a boss 170, generally square in configuration, is attached to a front surface of the body 164 to which the leg 166 is attached. Further, provided within the upper surface of the body 164 is two cavities 171, generally rectangular in shape, and positioned proximate terminating ends. Also, as best seen in FIG. 13, provided within the lower surface of the body 164, and opposing the slot 168 is a slot 172. The difference in this slot 172 from the slot 168 is that the slot 170 does not extend the entire width of the body 164, but rather terminates by an end wall 174 which is proximate the front surface of the body 164, for the purpose described below. The engaging portion 116 may be manufactured from any suitable material; one example is plastic such as polycarbonate.

The base member 110 as shown in FIGS. 13 and 14 includes the cavity 176, generally rectangular in configuration, into which the engaging portion 116 is received. The cavity 176 is defined by an upper surface 178 and a lower surface 180. In this embodiment, an upper boss 182 is attached to the upper surface 178 and a lower boss 184 is attached to the lower surface 180. The upper boss 182 in this embodiment is generally rectangular in shape and positioned so as to be received into the slot 168 provided within the upper surface of the engaging portion 116. The lower boss 184 in this embodiment includes a generally ramped camming wall and a locking wall substantially perpendicular to the lower surface 180 which operates to retain the engaging portion 116. Specifically, upon assembly the engaging portion 116 is positioned so that the leg 166 is first received within the cavity 176 in the base member 110. The slot 168 is received onto the upper boss 182, and the end wall 174 first engages the camming surface of the lower boss 184, and when mounted the end wall 174 is adapted to engage the locking surface of the lower boss 184 to prevent the engaging portion 116 from separating from its position within the base member 110. In the assembled position, the leg 166 of the engaging portion 116 engages a rear surface 190 defined by the cavity 176. Specifically, as the engaging portion 116 in operation engages a second panel or frame member, the engaging portion 116 will be moved from an extended position in an inward direction toward the base member 110 to a retracted position due to the flexing action of the leg 166. Similarly, the resiliency of the leg 166 operates to return the engaging portion 116 toward its original position and to the extended position when not engaging the second panel or frame member, such as when the lock is in an open position.

Figure 10:
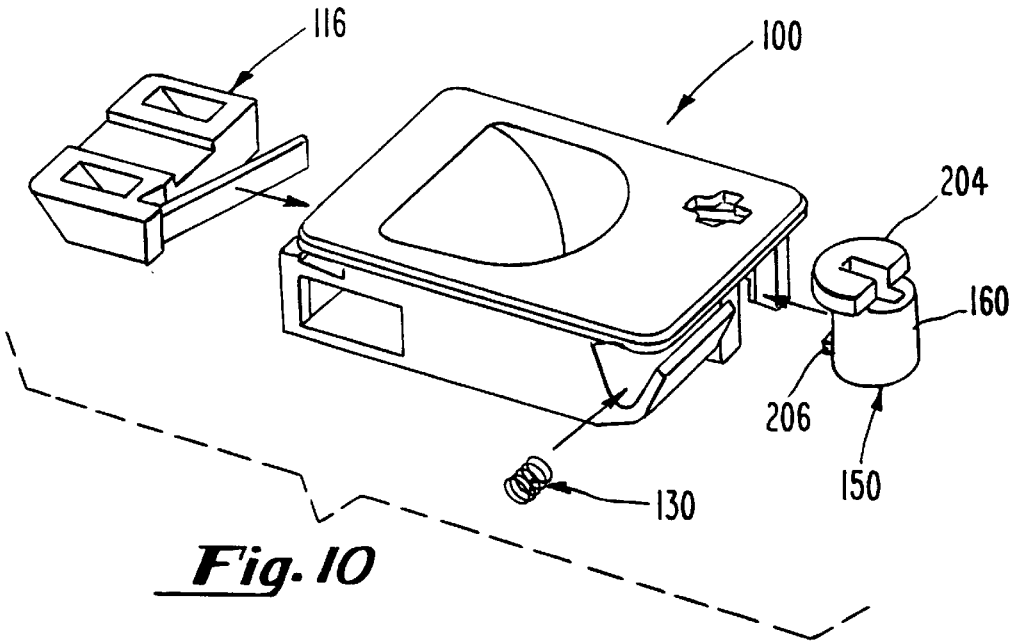
FIG. 10 is an exploded perspective view of a latch in accordance with another embodiment of the present invention.
Figure 11:
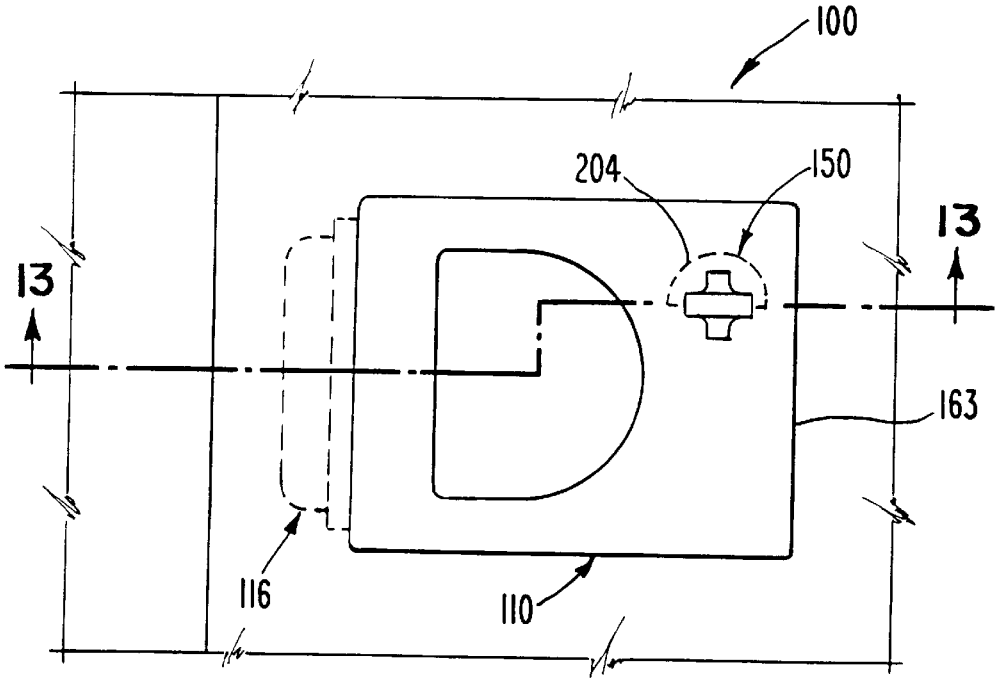
FIG. 11 is a top plan view of the latch of FIG. 10, shown in a mounted position.
Figure 12:
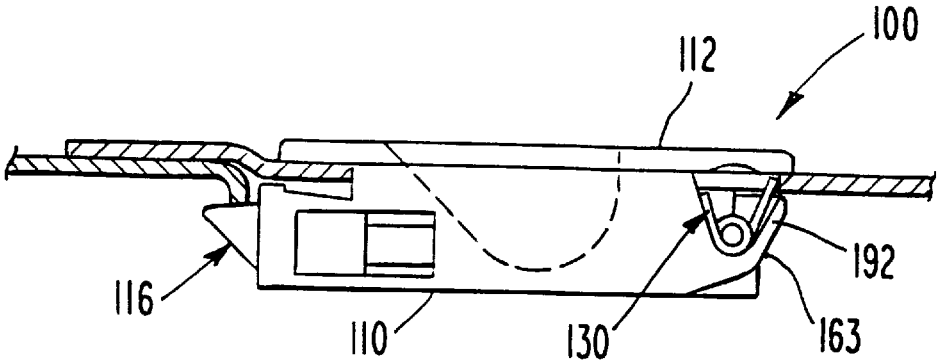
FIG. 12 is a left side view of the latch of FIG. 10.

The spring member 130 in this embodiment as best seen in FIGS. 10, 12 and 14 comprises a torsion spring, preferably of metal, and received within the base member 110 proximate its rear surface 163 Specifically, the body member 110 in this embodiment includes a lip 192, which extends approximately half the length of its rear surface 163, and which defines a channel 193, generally V-shaped, into which the spring member 130 is received. In this embodiment, one leg of the torsion spring is positioned within the gap between the lip 192 and surface 112 of the base member 110 and the second leg of the torsion spring is received within a groove 194 provided within the base member 110 proximate the channel 193.

The locking member 150 in this embodiment as best seen in FIGS. 10, 13 and 14 comprises a boss 204 connected with the lock plug 160. In the present embodiment, the boss 204 is generally semi-circular in shape and attached at one end to the lock plug 160. In addition, a retaining boss 206 is attached to the locked plug 160 at the end opposite the boss 204, the purpose of which will be described hereafter.

The body member 110 is adapted to receive the lock plug 160 for rotation of the locking member 150 corresponding with rotation of the lock plug 160. In this embodiment, the base member 110 is provided with an upper cavity 210 into which the boss 204 is received, a central cavity 211 into which the cylindrical body of the lock plug 160 is received, and a channel 214, which in this embodiment is approximately 45° in length into which the retaining boss 206 is received. Specifically, the end walls of the channel 214 operate to limit the rotation of the lock plug 160 due to its engagement with the retaining boss 206. In operation of the present embodiment, when in a locked position, the lock plug 160 is moved so that the boss 204 of the locking member 150 is positioned with part of its radiused portion positioned proximate the rear surface 163 of the base member 110, and in this position is adapted to abut the panel surface formed by the cut-out portion when the base member 110 is slide relative to the panel, such as shown in dotted lines in FIG. 11. In an open position, the lock plug 160 is in a position so that the planar portion of the boss 204 of the locking member 150 is positioned adjacent the rear surface 163 of the base member 110, so that the base member 110 can be slid relative to the panel in which the latch is mounted, such as shown in FIG. 10. In this embodiment, the length of the channel 214 is such that when the locking member 150 is in its open position, the detent boss 206 is positioned against one end wall of the channel 214, and when the locking member 150 is in its closed position the detent boss 206 is positioned against the opposite end wall of the channel 214. The combination locking member and lock plug in this embodiment can be manufactured from any suitable material, one example is plastic such as ABS.

The remaining structure and operation of the lockable slide latch 100 is the same as that described earlier in the application and shown in FIGS. 1–9, and for the sake of brevity will not be further described herein.

Figure 15:
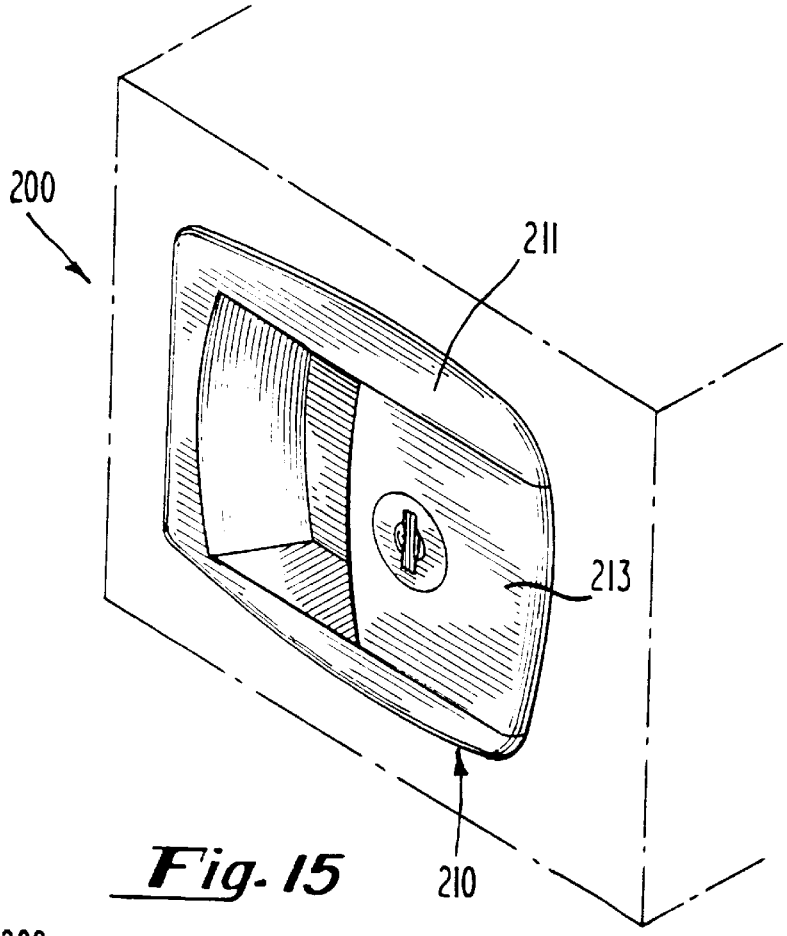
FIG. 15 is a perspective view of a latch in accordance with another embodiment of the present invention, shown mounted in a panel in dotted lines.
Figure 16:
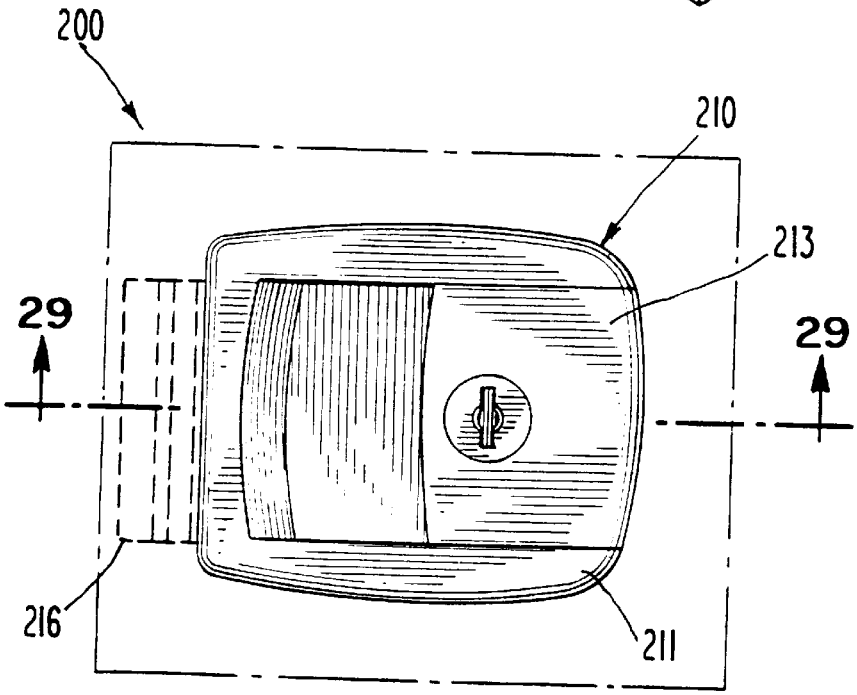
FIG. 16 is a top plan view of the latch of FIG. 15.

In FIGS. 15–34 is shown a locking slide latch in accordance with another preferred embodiment of the present invention. For the sake of clarity, the portions of the locking slide latch in accordance with the present embodiment which correspond to the portions described in relation to the embodiments of the locking slide latch earlier described and shown in FIGS. 1–14 will be described using the same number designations beginning with 200. The locking slide latch 200 similar to the locking slide latches earlier described also comprises, as portions thereof, a body portion, a spring member and a locking member. As will be described in more detail below, the primary differences in the locking slide latch 200 from that earlier described is the configuration of the body portion, which comprises a base member 210 having a housing 211 and actuator means comprising an actuating member 213, and that no separate spring member is required, but rather is incorporated into an engaging portion or pawl 216. In FIGS. 15 and 16 are shown a perspective and top plan views of the locking slide latch 200 shown mounted in a panel illustrated in dotted lines, and in which the housing 211 and actuating member 213 of the base member 210 are illustrated, as well as the pawl 216 shown in dotted lines behind the panel.

Figure 17:
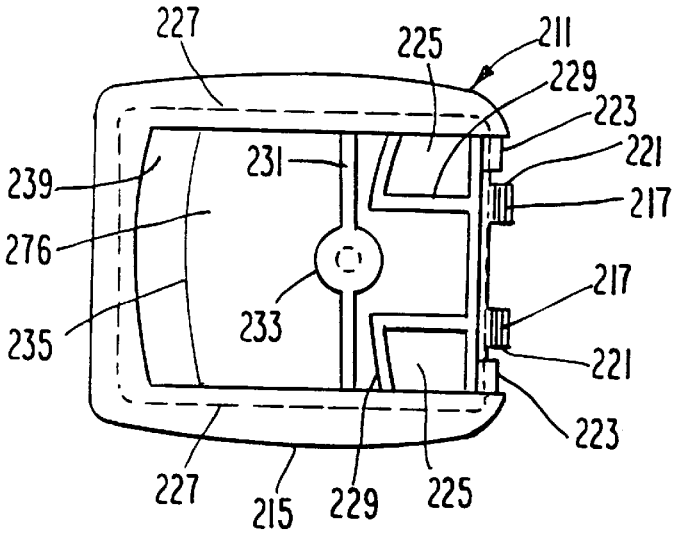
FIG. 17 is a top plan view of a housing of the latch of FIG. 15.
Figure 18:
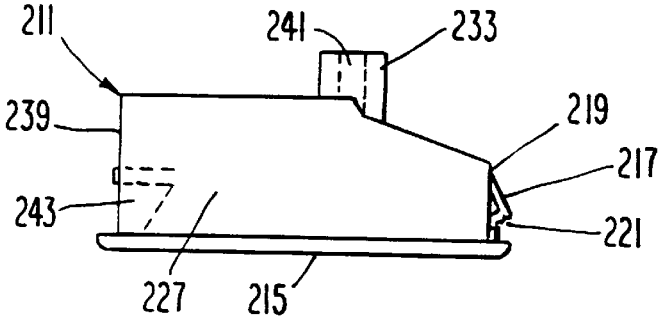
FIG. 18 is front elevational view of the housing of FIG. 17, the rear elevational view being a mirror image of that shown.
Figure 19:
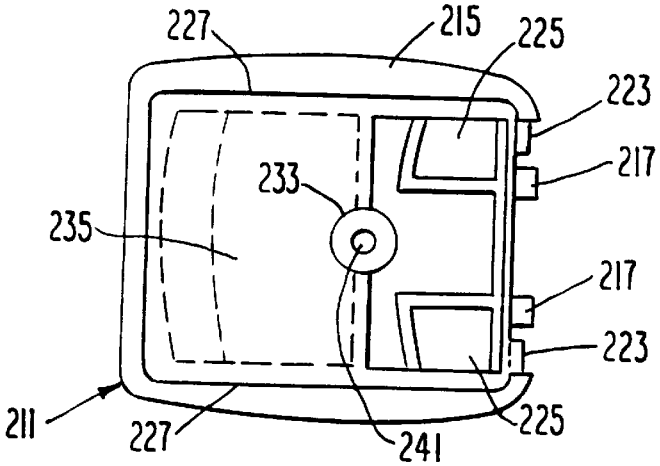
FIG. 19 is a bottom plan view of the housing of FIG. 17.
Figure 20:
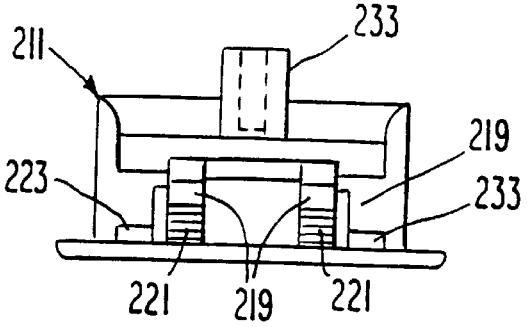
FIG. 20 is right side elevational view of the housing of FIG. 17.
Figure 21:
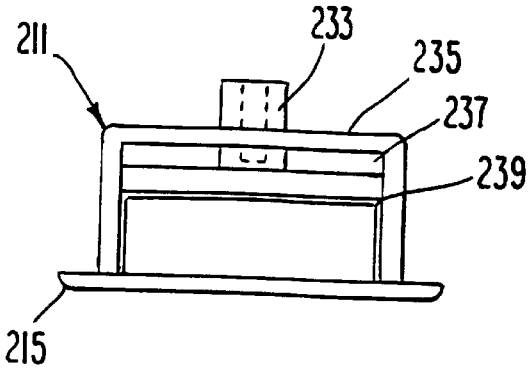
FIG. 21 is a left side elevational view of the housing of FIG. 17.

The housing 211 of the base member 210 is illustrated in FIGS. 17–21. Housing 211 is generally square shaped in configuration in this embodiment and includes a flange 215 extending around three sides of the housing 211. Further, extending from the open side of housing 211, in which the flange is not present, is at least one and preferably in this embodiment two substantially flexible barbs 217, which as best shown in FIGS. 18 and 20 are attached at one end to a front wall 219 of housing 211 and its distal end is preferably provided with a series of serrations 221. Also extending from the front wall 219 adjacent to the barbs 217 are two substantially square shaped extensions 223, which are most easily seen in FIGS. 17, 19 and 20. As shown in the top plan view of FIG. 17, extending within the top surface of the housing 211 is a substantially square shaped cavity 276. Also, provided within the cavity 276 are at least one and preferably two generally square shaped channels or bores 225 adjacent to the front wall 219, which are formed by portions of the front wall 219, portions of opposing side walls 227 attached with the front wall 219 and a generally L-shaped end wall 229 attached at one end to the front wall 219 and at its second end to one side wall 227. Also, adjacent to the bores 225 is a dividing wall 231 extending between the side walls 227 and having a substantially cylindrical portion 233 bisecting the dividing wall 231. Also, adjacent and connected to the dividing wall 231 is a bottom wall 235 which is also attached to the side walls 227. As best illustrated in FIG. 21, the bottom wall 235 terminates adjacent to an aperture 237 which is substantially rectangular in configuration provided within a back wall 239. As best seen in FIG. 17, preferably a portion of the back wall 239 is slightly curved in a direction of the front wall 219 beginning at the flange 215 and inward to the bottom wall 235. As best illustrated in FIGS. 18 and 19, the substantially cylindrical portion 233 which bisects the dividing wall 231 preferably has a substantially cylindrical aperture 241 extending within its bottom end and preferably terminating adjacent to its top end, which is the end closer to the flange 215. Also, in this embodiment as best shown in FIG. 18 in dotted lines, the back wall 239 defines a generally radiused V-shaped cavity 243 adjacent to the flange 215.

Figure 22:
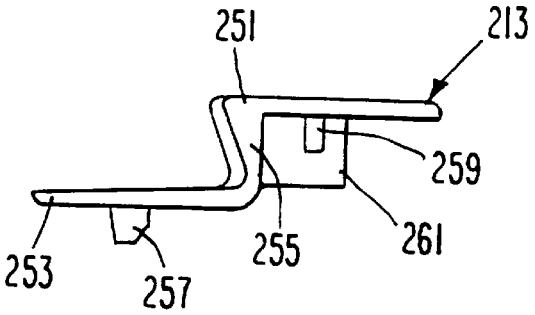
FIG. 22 is a front elevational view of an actuator means of the latch of FIG. 15, the rear elevational view being a mirror image of that shown.
Figure 23:
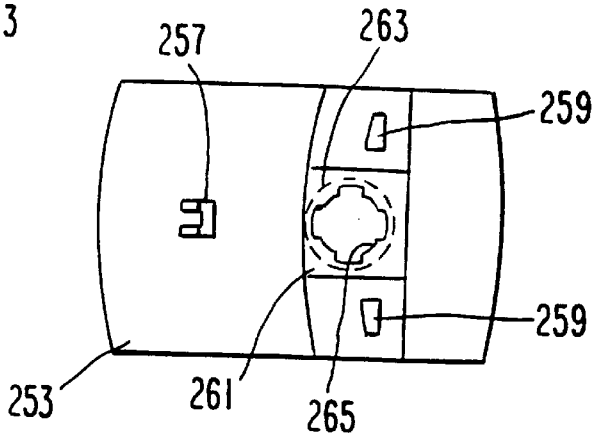
FIG. 23 is a bottom plan view of the actuator means of FIG. 22.
Figure 24:
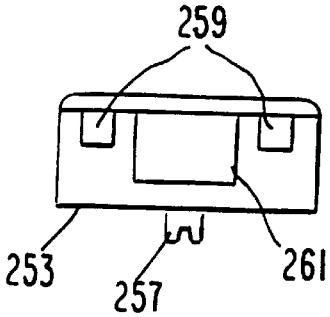
FIG. 24 is right side elevational view of the actuator means of FIG. 22.

The actuating means or actuating member 213 in this embodiment is shown in FIGS. 22–24. As shown in the front elevational view of FIG. 22, the actuating member 213 is generally S-shaped having a substantially planar first portion 251, a substantially planar second portion 253 and a connecting portion 255. In this embodiment, the connecting portion 255 includes within its outer surface a slight inward radius adjacent to the second portion 253. In addition, extending from a bottom surface of the second portion 253 is preferably at least one boss 257. As illustrated in the bottom plan view of FIG. 23, the boss 257 in this embodiment is generally C-shaped formed by a back wall and two side walls. Also, as illustrated in FIG. 22 and the right side elevational view of FIG. 24, the boss 257 in this embodiment has a bottom surface which ramps inward in a direction from its front end toward a back end of the boss 257, which is the end closest to the first portion 251. Further, as most easily seen in FIGS. 23 and 24, extending from a bottom surface of the first portion 251 is at least one and in this embodiment preferably two bosses 259, which are preferably substantially square shaped in configuration. Also, as best illustrated in FIGS. 22 and 24, extending from the bottom surface of the first portion 251 is a body portion 261, which is substantially square shaped in this embodiment connected with both the bottom surface of the first portion 251 and inner surface of the connecting portion 255. Also, as shown in FIG. 23, preferably the body portion 261 is included with an aperture therethrough, which in this embodiment is defined by a substantially circular aperture 263 provided in a top surface of the first portion 251 and which terminates by an irregularly shaped aperture 265 extending through the bottom surface of the first portion 251. In this embodiment the irregularly shaped aperture 265 is comprised of a series of alternating inwardly and outwardly shaped recesses extending around the circumference.

Figure 25:
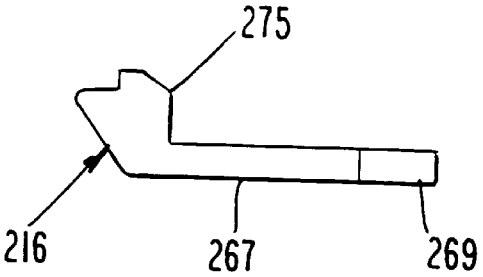
FIG. 25 is a front elevational view of a pawl of the latch of FIG. 15, the rear elevational view being a mirror image of that shown.
Figure 26:
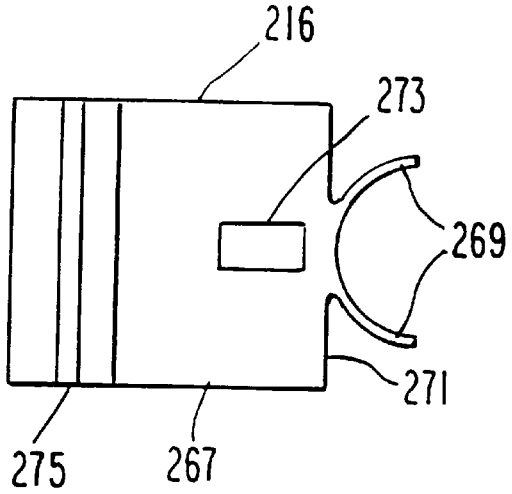
FIG. 26 is a top plan view of the pawl of FIG. 25.
Figure 27:
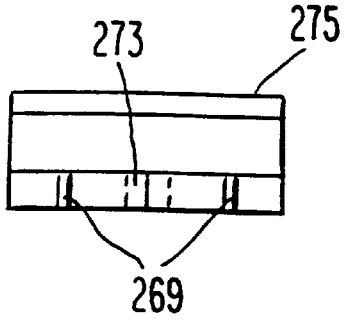
FIG. 27 is a right side elevational view of the pawl of FIG. 25.

The engaging portion or pawl 216 in this embodiment is shown in FIGS. 25–27. The pawl 216 includes, as portions thereof, a body 267 and biasing means, which comprises in this embodiment at least one and preferably two generally resilient legs 269 attached to the body 267. As best illustrated in FIG. 26, the two generally resilient legs 269 are each generally radiused in configuration and attached at one end to an inner wall 271 of the body 267 of the pawl 216. In this manner, the two generally resilient legs 269 are in combination substantially U-shaped. In addition, the body 267 of the pawl 216 also includes at least one cavity 273, which in this embodiment extends completely through the pawl 216 and is generally rectangular in configuration and positioned adjacent to the biasing means 269. As best shown in FIG. 25, the pawl 216 further includes a latching portion 275.

Similar to that earlier described, the housing 211, actuating member 213 and pawl 216 are each preferably manufactured from corrosion resistant materials such as plastics, for example ABS or ACETAL.

Figure 28:
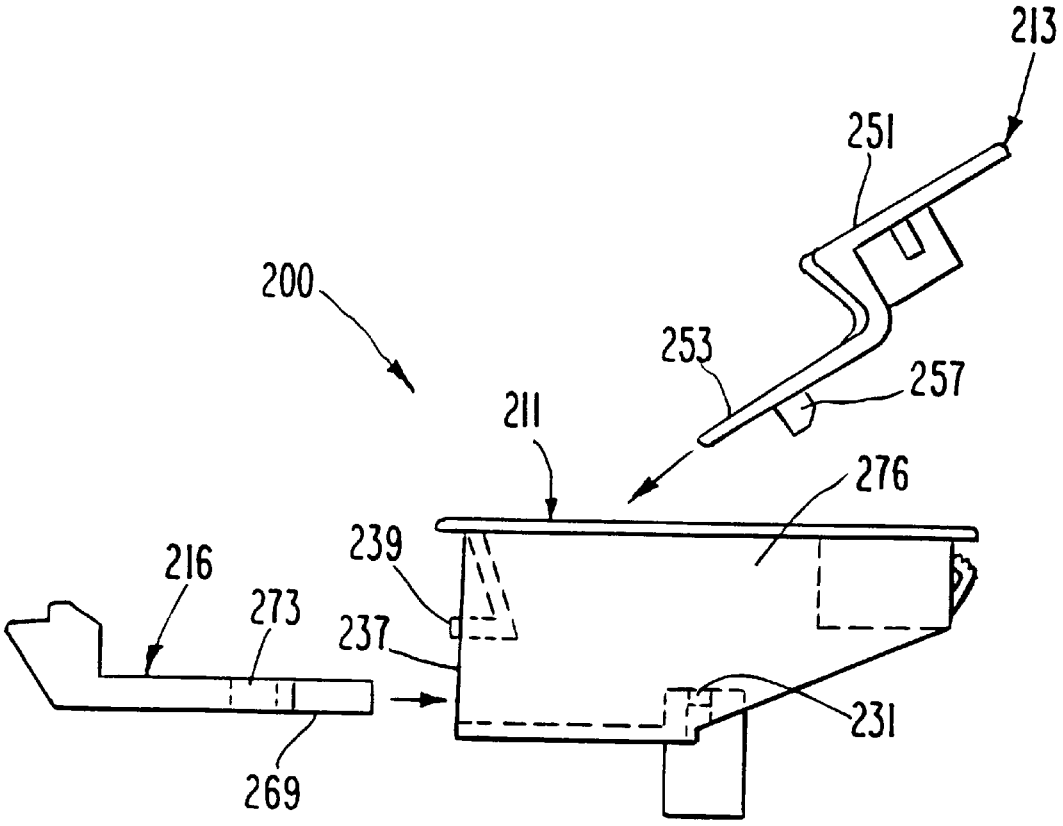
FIG. 28 is an exploded front elevational view of the latch of FIG. 15.

Assembly of the locking slide latch 200 will now be described. As illustrated in FIG. 28, the pawl 216 and actuating member 213 are each inserted into the housing 211. In particular, the pawl 216 is assembled by inserting the biasing means 269 into the aperture 237 providing in the back wall 239. Actuating member 213 is assembled by inserting the second portion 253 first into the cavity 276 of the housing 211 and then into the housing cavity 237 within the back wall 239, which is preferably adjacent the pawl 216 so that the boss 257 of the actuating member 213 will be received into the aperture 273 provided in the pawl 216, in the manner illustrated in FIG. 29. It has been found that assembly is most easily accomplished by first inserting the pawl 216 so that the two generally resilient legs 269 will come into engagement with the dividing wall 231 of the housing 211, followed then by inserting the second portion 253 of the actuating member 213 into the remaining space between the pawl 216 and housing cavity 237.

As illustrated in the sectional elevational view of FIG. 29 taken along the line 29—29 of FIG. 16, the interaction between the boss 257 of the actuating member 213 and aperture 273 of the pawl 216 operates as coupling or displacement means for attaching the portions together and, as will be described hereinafter, for displacing or moving the pawl between an extended position and a retracted position.

Figure 29:
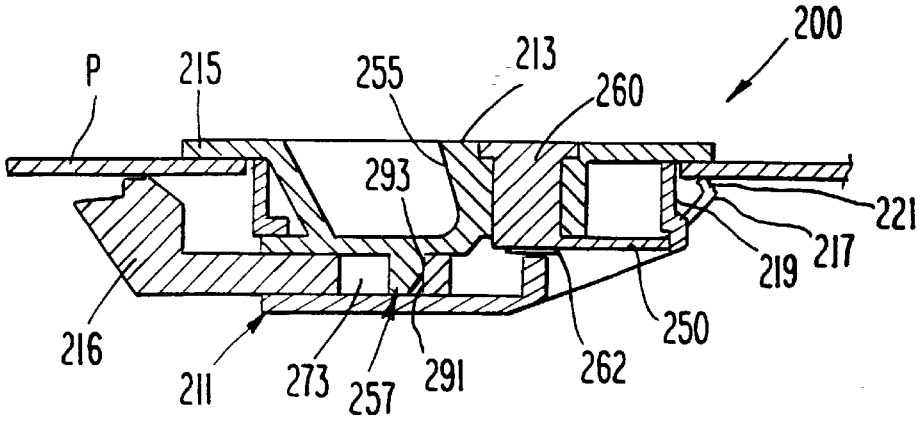
FIG. 29 is a sectional front elevational view of the latch of FIG. 15 taken along the line 29—29 of FIG. 16 and in a locked position.

The locking means in this embodiment is illustrated in FIG. 29 comprising the lock plug 260 and locking member 250. The lock plug 260 is received within and extends through the apertures 263 and 265 within the body portion 261 of the actuating member and receives the locking member 250 for rotation. Similar to that earlier described, the lock plug 260 may be operated by a key, such as illustrated in FIGS. 15 and 16. In this embodiment, the lock plug 260 preferably includes a generally cylindrical portion and, adjacent to its end distal the key opening, is irregularly shaped, which in this embodiment corresponds to the series of alternating inwardly and outwardly shaped recessed portions of the opening 255. In this manner, installation of the lock plug 260 is regulated by the position of the distal end of the lock plug together with the shape of the aperture 265. Further, in this embodiment, preferably the locking member 250 includes an aperture therethrough corresponding in configuration with the configuration of the distal end of the lock plug 260, so that the mounting of the locking member 250 upon the distal end of the lock plug 260 is also regulated so as to be dependent upon the recessed portions of the lock plug 260. In the present embodiment, preferably the locking member 250 is mounted onto the lock plug 260 after both the lock plug has been inserted into the apertures 263 and 265 of the actuating member 213 and the actuating member 213 is seated within the housing 211. The locking member 250 is then secured onto the lock plug 260 by a retaining clip 262 which is press fit into a groove provided within the distal end of the lock plug 260.

Figure 30:
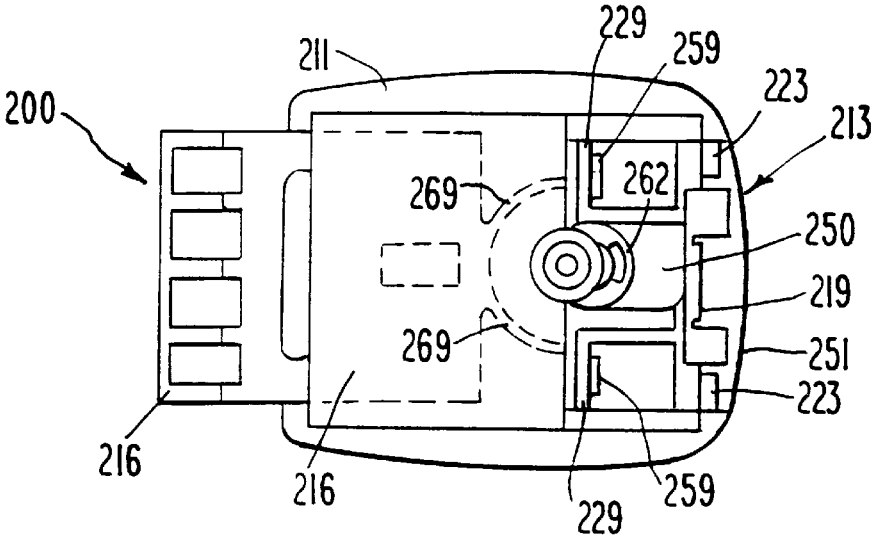
FIG. 30 is a bottom plan view of the latch of FIG. 15 shown without a panel and in a locked position.

The operation of the locking slide latch 200 in accordance with the present embodiment will now be described. As is illustrated in FIG. 29, the housing 211 is mounted within the aperture in the panel P so that the lower portion of the flange 215 is positioned abutting a top surface of the panel P. Further, although not shown, preferably as the housing 211 is being mounted, the barbs 217 are adapted to contact the edge of the aperture in the panel P so as to initially flex the barbs 217 inward, with the barbs 217 then flexing back towards their original position when mounted and the serrated ends 221 preferably being positioned adjacent the edge of the panel aperture, which has the effect to help secure the latch within its mounted position. FIG. 29 illustrates the locking slide latch 200 in a locked position, with the locking member 250 rotated so as to be positioned adjacent and preferably abutting the inside surface of the front wall 219 of the housing 211. In this manner, sliding movement of the actuating member 213 is prevented so as to maintain the latched position of the device, for example when secured against a frame or other corresponding member. In FIG. 30 is illustrated a bottom plan view of the locking slide latch 200 when in the locked position shown in FIG. 29 and which illustrates the position of the locking member 250 relative to the front wall 219 of the housing 211.

Further, in this embodiment, preferably when the locking slide latch 200 is in the locked position, the bosses 259 within the actuating member 213 are positioned adjacent and preferably abutting one leg of the substantially L-shaped walls 229, as is shown in FIG. 30. Although not shown, preferably the bosses 259 and L-shaped end walls 229 will also maintain the same relationship when the locking member 250 is rotated to its unlocked position, so as to define a maximum amount of sliding movement of the actuating member 213 when moved into a retracted position, which is in a direction toward the pawl 216. As will be described in more detail below, the relationship of the bosses 259 and connecting wall 255 of the actuating member 213 together with the L-shaped walls 229 of the housing 211 define limit means for regulating the amount of sliding movement of the actuating member 213. Further, as illustrated in FIG. 30, in this embodiment the lower surface of the first portion 251 of the actuating member preferably rides against the bosses 223 of the housing 211, as the actuating member 213 undergoes sliding movement relative to the housing 211.

Figure 31:
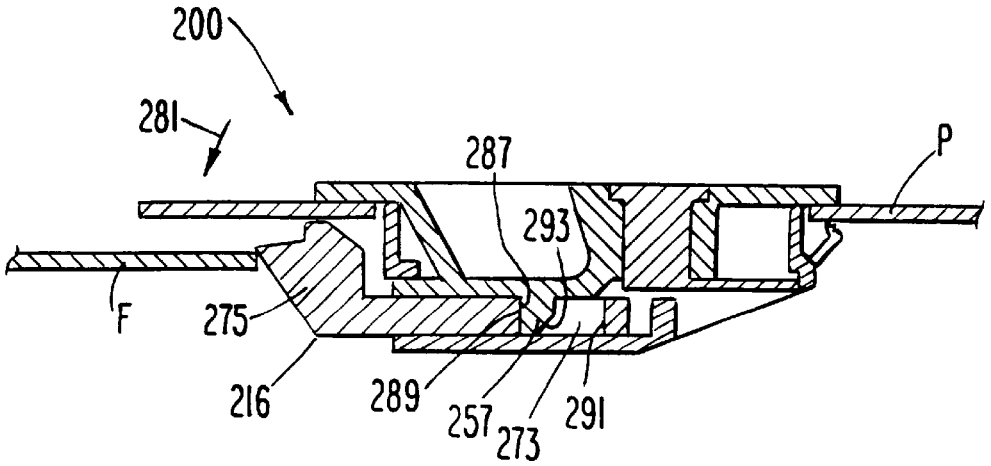
FIG. 31 is a sectional front elevational view of the latch of FIG. 15 taken along the line 29—29 in FIG. 16 and shown without a panel, the latch of FIG. 31 being shown in a locked position and with the pawl a retracted position.

Similar to the locking slide latch 100 earlier described, one feature of the locking slide latch 200 is that the pawl 216 can be moved between its extended and retracted positions when the latch is both in its locked and unlocked positions. FIG. 31 illustrates the locking slide latch 200 in a locked position, such as illustrated in FIGS. 29 and 30, and with the panel P being moved in a direction of arrow 281 into a closed position against a frame F. As is illustrated, the pawl 216 includes a ramped end of its latching portion 275 which comes into engagement with the frame F as the panel P is being moved into the closed position. The engagement between the pawl 216 and frame F forces the pawl 216 from its extended position in a direction toward its retracted position, as the panel P continues its movement toward the closed position. FIG. 31 illustrates the pawl 216 being in a fully retracted position, with the rear end wall 287 of the boss 257 being in engagement with the rear end surface 289 of the aperture 273. In this embodiment, the amount of displacement of the pawl 216 along a longitudinal axis between its fully retracted and fully extended positions is dependent upon a diameter of the aperture 273 between the two opposing end surfaces 289 and 291 as compared to a diameter of the boss 257 between the opposing end walls 287 and 293. For example, in FIG. 29 illustrates a fully retracted position of the pawl 216 in which the front end wall 293 of the boss 257 is in engagement with the front end surface 291 of the aperture 273, and in FIG. 31, when in the fully extended position, the opposite rear end wall 287 of the boss 257 engages the rear end surface 289 of the aperture 273. In this embodiment, the diameter of the aperture 273 is larger than the diameter of the boss 257. Although not shown, when the panel P is moved into the closed position, the pawl 216 is moved past the frame F and back toward its extended position due to the bias of the two generally resilient legs 269. In FIG. 30 is illustrated in dotted lines the position of the two generally resilient legs 269 when the pawl 216 is in its extended position.

Figure 32:
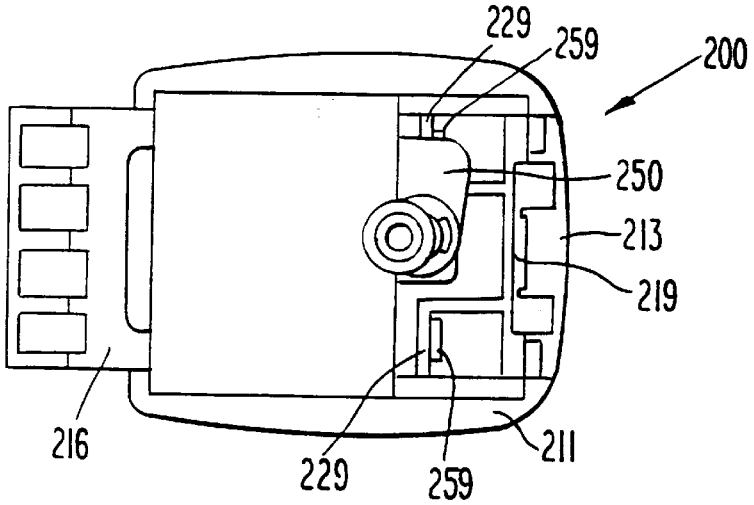
FIG. 32 is a bottom plan view of the latch of FIG. 15 shown without a panel and in an unlocked position.
Figure 33:
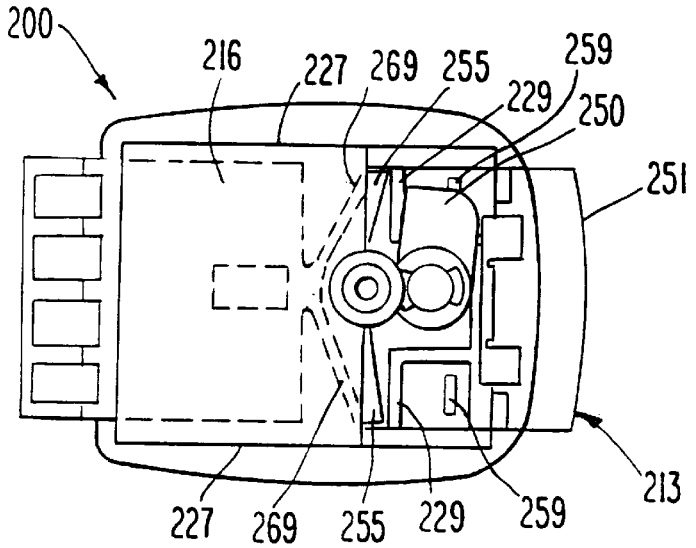
FIG. 33 is a bottom plan view of the latch of FIG. 15 shown without a panel and in an unlocked position, with the actuator means slid to a retracted position and the pawl in a retracted position.
Figure 34:
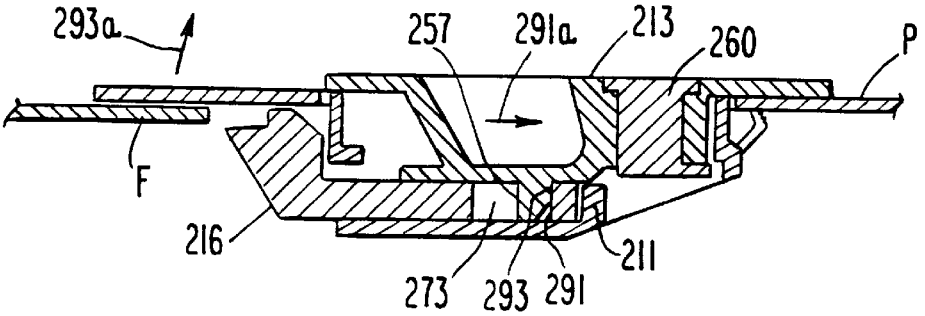
FIG. 34 is a sectional front elevational view of the latch of FIG. 15 taken along the line 29—29 of FIG. 16 and shown without a panel, the latch of FIG. 34 being shown in an unlocked position and with both the actuator means and the pawl in a retracted position.

FIG. 32 illustrates a bottom plan view of the latch 200 with the locking member 250 rotated into the unlocked position away from the end wall 219 of the housing 211. In the bottom plan view of FIG. 33 and front sectional view of FIG. 34 is shown the locking slide latch 200 when the actuating member 213 is moved by an operator in the direction of arrow 291 to slide relative to the housing 211 into a fully retracted position, so as to retract the pawl 216 from the frame F in order that the panel P can be moved in the direction of arrow 293 from its closed to its opened position. As shown in FIG. 34, the engagement between the front end wall 293 of the boss 257 with the front end surface 291 of the aperture 273 provides the retracting movement of the pawl 216 as the actuating member 213 is made to slide into its retracted position. As illustrated in dotted lines in FIG. 33, the retraction of the pawl 216 occurs against the bias of the generally resilient legs 269, which results with the legs 269 being slightly compressed and extended in a direction of the opposing side walls 227 of the housing 211. The stored energy in the generally resilient legs 269 when in the position of FIG. 33 will work to force both the pawl 216 and actuating member 213 back toward the original positions shown in FIG. 32 when the operator releases contact with the latch 200. Alternatively, when the latch 200 is in a locked position shown in FIG. 31 and with only the pawl 216 in an extended position, the stored energy within the generally resilient legs 269 will work to force the pawl 216 back toward its extended position when clear of the frame F.

Further, another feature of the present invention is that there are limit means for regulating the amount of sliding displacement that can occur with the actuating member 213 between its retracted and extended positions. In the present embodiment, the limit means are illustrated in FIGS. 32 and 33. In FIG. 32, the bosses 259 of the actuating member 213 are in engagement with the L-shaped walls 229 of the housing 211 when the actuating member 213 is in its fully retracted position. In FIG. 33, the connecting portion 255 of the actuating member 213 defines a stop which comes into engagement with the L-shaped walls 229 of the housing 211 when the actuating member 213 is in its fully extended position.

In view of that set forth above, it should be understood that there are several advantages to the locking slide latch 200. One advantage is that the pawl is separate from the latch body and can move independent of the latch body regardless of the locked position, which in operation allows a panel to be slammed shut even when the latch is locked. Another advantage is that the housing forms a framework for the actuating member and pawl to slide within, however, the housing itself never moves with respect to the panel once it is installed. In this manner, when the latch is in a locked position, only the motion of the actuating member is restricted with respect to the housing. Still another advantage of the present invention is that the pawl includes biasing means in the form of two resilient legs which provides the two functions to both urge the pawl alone to its extended position when the latch is locked and also to urge both the pawl and actuating member to their extended positions when the latch is unlocked. Accordingly, no separate spring member is required within the latch.

While the present invention is described in terms of the preferred embodiments, many modifications and variations are possible. For example, various spring configurations may be used in place of the disclosed spring member and generally resilient legs. Furthermore, the function of the spring member and the rotating locking member may be combined through the use of a unitary rotating member that, in one orientation, acts as a spring to bias the latch in the closed position and, in another orientation, acts as a locking member to prevent movement of the latch.

Accordingly, it is understood that the above description of the present invention is susceptible to considerable modifications, changes and adaptations by those skilled in the art, and that such modifications, changes and adaptations are intended to be considered within the scope of the present invention, which is set forth by the appended claims.

We claim:

1. A slide latch adapted for mounting on a first member for latching of said first member to a second member, said slide latch comprising:

a housing adapted for mounting on said first member, wherein said housing includes a housing body, a flange and means for mounting said housing substantially fixed with an aperture in said first member, whereby, when said slide latch is mounted within said first member, sad housing body is positioned within said aperture in said first member and said flange engages on outer surface of said first member;

latching means comprising a pawl received within at least a portion of said housing for sliding movement between extended and retracted positions relative to said housing;

actuator means associated with and slidable relative to said housing for displacing said pawl from said extended position to said retracted position;

locking means comprising a lock plug having a locking member rotatably mounted on said actuator means and adapted to rotate between a locked position engaging said housing that substantially prevents said actuator means from being slidable relative to said to thereby maintain the side latch in a fastened position and an unlocked position in which said actuator means is slidable relative to said housing; and displacement means between said pawl and said actuator means for sliding movement of said pawl relative to said housing and said actuator means when the locking member is in both the locked position and the unlocked position, whereby when the pawl comes into contact with said second member when the first and second members are latched together and when the locking member is in both the locked and unlocked positions the pawl will slide from the extended position toward the retracted position so that the pawl can move past the second member and back toward the extended position for latching;

wherein said flange of said housing includes an upper wall and a cavity within said upper wall extending into said housing body and said housing body includes a back wall, wherein said actuator means comprises a gripable portion and an opening receiving said lock plug, with said actuator means and said lock plug being positioned within said cavity within said flange of said housing, wherein said locking member is positioned adjacent said back wall of said housing when in said locked position, and said locking member is positioned at spaced separation from said back wall of said housing when in said unlocked position.

2. A slide latch according to claim 1, wherein said latch further includes biasing means between said pawl and said housing for biasing said pawl to the extended position.

3. A slide latch according to claim 2, wherein said biasing means comprises at least one generally resilient leg extending from said pawl.

4. A slide latch according to claim 3, wherein said biasing means comprises two generally resilient legs attached to an end surface of said pawl, whereby said two generally resilient legs in combination are substantially U-shaped.

5. A slide latch according to claim 1 further including coupling means between said actuator means and said pawl for displacing said pawl from said extended position to said retracted position upon actuation of said actuator means.

6. A slide latch according to claim 5, wherein said actuator means comprises a generally elongate actuating member and said coupling means comprises at least one boss extending from a lower surface of said generally elongate actuating member and received into an aperture within said pawl, whereby said pawl is displaced from said extended position to said retracted position by sliding movement of said generally elongate actuating member.

7. A slide latch according to claim 1 further comprising limit means between said actuator means and said housing for limiting said sliding movement of said actuator means relative to said housing.

8. A slide latch according to claim 7, wherein said limit means comprises at least one boss extending from a lower surface of said actuator means, a stop extending from said lower surface of said actuator means at spaced separation from said boss and of said housing between said at least one boss and said stop of said actuator means.

9. A slide latch adapted for mounting in an aperture in a first member and for latching to a second member, said slide latch comprising:

a housing having a body, a flange and means for mounting said housing substantially fixed within said first member aperture;

a pawl connected with said housing for movement between an extended position and a retracted position relative to said housing;

biasing means between said pawl and said housing for urging said pawl to its extended position;

actuator means attached to and slidable relative to said housing and coupled to said pawl for moving said pawl to its retracted position;

a lock plug mounted on said actuator means and having a locking member, wherein when said slide latch is mounted ill said first member, rotation of said lock plug causes rotation of said locking member between a locked position that substantially prevents said actuator means from sliding relative to said housing, and an unlocked position in which said actuator means is slidable relative to said housing; and wherein said housing body includes front and back walls, opposing side walls, a lower wall and at least one resilient tab extending from said housing body for snap-fit mounting of said housing within said aperture of said first member, and wherein said flange of said housing includes an upper surface generally opposing and at spaced separation from said lower wall, with said flange including a cavity within said upper surface and terminating by said lower wall, and wherein said front wall of said body includes an opening extending said cavity and terminating by a mid wall, wherein said pawl defines a pawl body positioned within said opening within said front wall and having said biasing means at one end engaging said pawl body and a second end engaging said mid wall of said housing.

10. A slide latch according to claim 9 further comprising displacement means between said pawl and said actuator means for moving said pawl relative to said housing and said actuator means between the extended position and the retracted position when the locking member is in both the locked position and the unlocked position.

11. A slide latch according to claim 10, wherein said actuator means comprises a gripable portion and an opening receiving said lock plug, with said actuator means positioned within said cavity within said flange of said housing, wherein said locking member is positioned adjacent said back wall of said housing when in said locked position, and said locking member is positioned at spaced separation from said back wall of said housing when in said unlocked position.

12. A slide latch according to claim 11, wherein said pawl includes at least one aperture within said body and said actuator means comprises a generally elongate actuating member having at least one boss on a lower surface thereof, wherein said displacement means comprises said at least one boss received within said at least one aperture, with said boss and said aperture each being of a defined diameter along a longitudinal axis, and said defined diameter of said aperture being larger than said defined diameter of said boss along said longitudinal axis.

13. A slide latch according to claim 12, wherein said housing body includes two resilient tabs extending from said back wall and said biasing means comprises at least one generally resilient and elongated leg attached at one end to said pawl body and having its second end engaging said mid wall of said housing.

14. A slide latch according to claim 13, wherein said biasing means comprises two generally resilient legs extending from a body of said pawl and engaging said mid wall of said housing.

15. A slide latch according to claim 13 further comprising limit means between said actuator means and said housing for limiting said sliding movement of said actuator means, wherein said limit means comprises at least one boss extending from a lower surface of said actuating member, a stop extending from said lower surface of said actuating member at spaced separation from said boss and adjacent said gripable portion and at least one wall of said housing between said at least one boss and said stop of said actuating member.

16. A slide latch according to claim 1, wherein said body of said housing includes front and back walls, opposing side walls, and at least one resilient tab extending from said back wall for snap-fit mounting of said housing within said aperture of said first member.

17. A slide latch according to claim 3, wherein said housing includes upper and lower walls at spaced separation, a cavity within said upper wall terminating by said lower wall, a front wall and an opening within said front wall extending into said cavity within said upper wall and terminating by a mid wall, wherein said pawl defines a pawl body positioned within said opening within said front wall of said housing and said at least one generally resilient leg is elongated and attached at one end to said pawl body and having its second end engaging said mid wall of said housing.

18. A slide latch according to claim 1, wherein said pawl includes a pawl body and at least one aperture within said pawl body and said actuator means comprises a generally elongate actuating member having at least one boss, wherein said displacement means comprises said at least one boss of said actuator means received within said at least one aperture of said pawl, with said boss and said at least one aperture each being of a defined diameter along a longitudinal axis, and said defined diameter of said aperture being larger than said defined diameter of said boss along said longitudinal axis.

* * * * *

UNITED STATES PATENT AND TRADEMARK OFFICE

CERTIFICATE OF CORRECTION

PATENT NO. : 5,974,842
DATED : November 2, 1999
INVENTOR(S) : Richard E. Schlack and Edward A. McCormack It is certified that error appears in the above-identified patent and that said Letters Patent is hereby corrected as shown below:

Column 2,
Line 29, replace “is front” with -- is a front --;
Line 63, replace “pawl a” with -- pawl in a --;

Column 4,
Line 45, delete “a”;

Column 5,
Line 12, replace “3F” with -- 8F --;

Column 13,
Line 53, replace “with” with -- within --;
Line 56, replace “ sad” with -- said --;

Column 14,
Line 1, replace “said to thereby” with -- said housing to thereby --;
Line 60, insert -- at least one wall -- after “from said boss and” and before “of said housing”;

Column 15,
Line 12, replace “ill” with -- in --;
Line 26, insert -- into -- after “extending” and before “said”;

Signed and Sealed this

Twenty-sixth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,974,842
DATED : November 2, 1999
INVENTOR(S) : Richard E. Schlack and Edward A. McCormack It is certified that error appears in the above-identified patent and that said Letters Patent is hereby corrected as shown below:

Column 3,
Lines 63-64, replace “is installed, the spring” with -- is installed. The spring --;

Column 13,
Line 57, replace “on” with -- an --;

Signed and Sealed this

Eighth Day of April, 2003

JAMES E. ROGAN
*Director of the United States Patent and Trademark Office*